US009474387B2

(12) United States Patent
McQuilton

(10) Patent No.: US 9,474,387 B2
(45) Date of Patent: Oct. 25, 2016

(54) SUPPORT PRODUCT

(71) Applicant: Specialised Orthotic Services Limited, Burton-on-Trent, Staffordshire (GB)

(72) Inventor: Gordon McQuilton, Burton-on-Trent (GB)

(73) Assignee: Specialised Orthotic Services Limited, Burton-on-Trent (GB)

( * ) Notice: Subject to any disclaimer, the term of this patent is extended or adjusted under 35 U.S.C. 154(b) by 0 days.

(21) Appl. No.: 14/408,969

(22) PCT Filed: Jun. 18, 2013

(86) PCT No.: PCT/GB2013/051579

§ 371 (c)(1),
(2) Date: Dec. 18, 2014

(87) PCT Pub. No.: WO2013/190279

PCT Pub. Date: Dec. 27, 2013

(65) Prior Publication Data

US 2015/0173524 A1 Jun. 25, 2015

(30) Foreign Application Priority Data

Jun. 20, 2012 (GB) ..... 1210953.4

(51) Int. Cl.

| | |
|---|---|
| ***A47D 15/00*** | (2006.01) |
| ***A47C 20/02*** | (2006.01) |
| ***A47D 13/08*** | (2006.01) |
| ***A47G 9/10*** | (2006.01) |

(52) U.S. Cl.

CPC ..... *A47D 15/00* (2013.01); *A47C 20/02* (2013.01); *A47D 13/08* (2013.01); *A47G 9/10* (2013.01); *A47G 2009/1018* (2013.01)

(58) Field of Classification Search

CPC ..... A47G 9/10; A47G 9/1081; A47G 9/109; A47G 2009/1018; A47D 13/08; A47D 13/083; A47D 15/005; A47D 15/00; A47C 16/00; A47C 16/005; A47C 20/02

USPC ..... D6/596, 601; 5/630–632, 636, 637, 5/640, 655, 655.9, 657

See application file for complete search history.

(56) References Cited

U.S. PATENT DOCUMENTS

| | | | | | |
|---|---|---|---|---|---|
| 264,814 | A * | 9/1882 | Wood | B63C 9/30 | 441/127 |
| 3,327,330 | A * | 6/1967 | McCullough | A47G 9/10 | 5/636 |
| 4,624,021 | A * | 11/1986 | Hofstetter | A47C 20/021 | 5/632 |
| 5,551,109 | A * | 9/1996 | Tingley et al. | 5/655 | |
| D384,536 | S * | 10/1997 | Kraft | D6/601 | |
| 5,682,632 | A * | 11/1997 | Cotroneo | A61G 13/1215 | 5/636 |
| 6,052,848 | A * | 4/2000 | Kelly | A47C 20/025 | 5/630 |
| 6,230,348 | B1 * | 5/2001 | Patrikakis | A47C 7/383 | 5/636 |
| 6,412,127 | B1 * | 7/2002 | Cuddy | 5/632 | |

(Continued)

FOREIGN PATENT DOCUMENTS

AU 2010214697 A1 3/2011

*Primary Examiner* — Nicholas Polito
(74) *Attorney, Agent, or Firm* — Law Offices of Michael L. Wise, LLC

(57) ABSTRACT

A support product (10) usable particularly for supporting disabled children. The product (10) in plan view has a generally U shape, and the inclination of the side limbs (20) relative to the base of the U can be varied. A plurality of alternate peaks (22) and troughs (24) are provided on an upper surface of the product.

12 Claims, 11 Drawing Sheets

(56) References Cited

U.S. PATENT DOCUMENTS

| | | | | |
|---|---|---|---|---|
| 6,760,934 | B1 * | 7/2004 | Leach | A47C 20/021 5/631 |
| D522,300 | S * | 6/2006 | Roberts | D6/601 |
| D530,136 | S * | 10/2006 | Toth | D6/601 |
| 7,185,604 | B2 * | 3/2007 | Holte | 119/28.5 |
| D624,346 | S * | 9/2010 | Salzman | D6/604 |
| D673,410 | S * | 1/2013 | O'Connell | D6/601 |
| 8,661,587 | B1 * | 3/2014 | Leach | 5/655 |
| 2007/0067914 | A1 | 3/2007 | Littlehorn et al. | |
| 2007/0118992 | A1 * | 5/2007 | Carlos | A47G 9/10 5/645 |
| 2009/0064419 | A1 * | 3/2009 | Owen | A47C 21/046 5/724 |

* cited by examiner

SUPPORT PRODUCT

This invention concerns a support product for a person, and particularly but not exclusively a support product for use in stabilising children, and particularly disabled children.

A wide range of support products have been proposed for stabilising in particular disabled children. Generally such products have only been usable in one or two applications or positions, and hence it may be necessary to stock a range of supports for use in different positional therapy or other situations.

According to the present invention there is provided a ground engageable support product for a person, the product comprising a profiled resilient member which is generally U shaped in plan view, the member having a generally flat ground engageable surface, with a profiled upper surface including a plurality of peaks and troughs along the length of the profiled member.

The product may be formed such that the relative inclination of one or both of the side limbs of the U relative to the base of the U, may be varied.

At least two peaks with a trough in between may be provided on each side limb of the U. A trough may be provided at the free end of the side limbs. A trough may be provided at the base of the U.

The overall height of the profiled member may increase from the free end of each side limb.

The profiled member may include a flexible plastics material profiled core, which may be made of a foamed material and may be polyurethane.

A removable washable cover may be provided around the profiled core. The cover may have an external texture which is engageable with floor coverings to retain the product in a required shape. The cover may be made of stretch velour.

A protective membrane may be provided around the profiled core, which membrane may be permeable to air but not water.

An embodiment of the present invention will now be described by way of example only and with reference to the accompanying drawings, in which.

Figure 1:
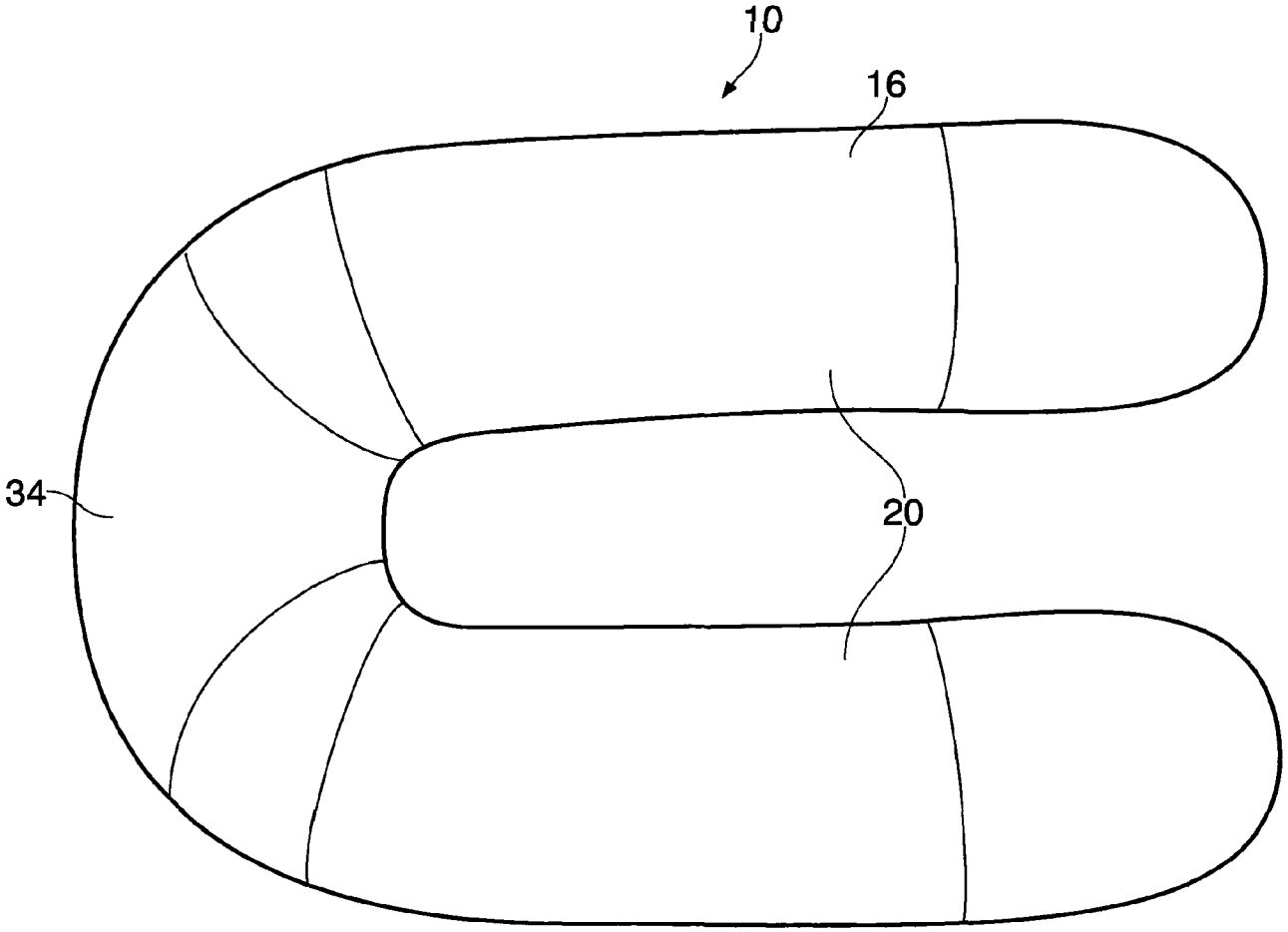
FIG. 1 is a plan view of a support product according to the invention.
Figure 2:
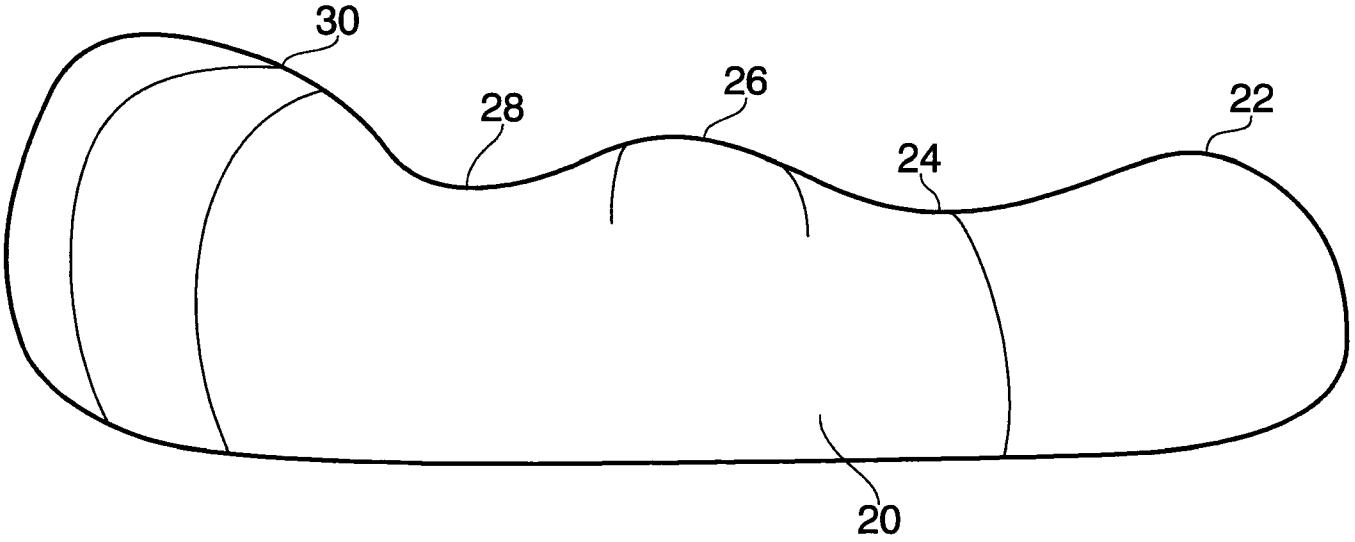
FIG. 2 is a side view of the product of FIG. 1.
Figure 3:
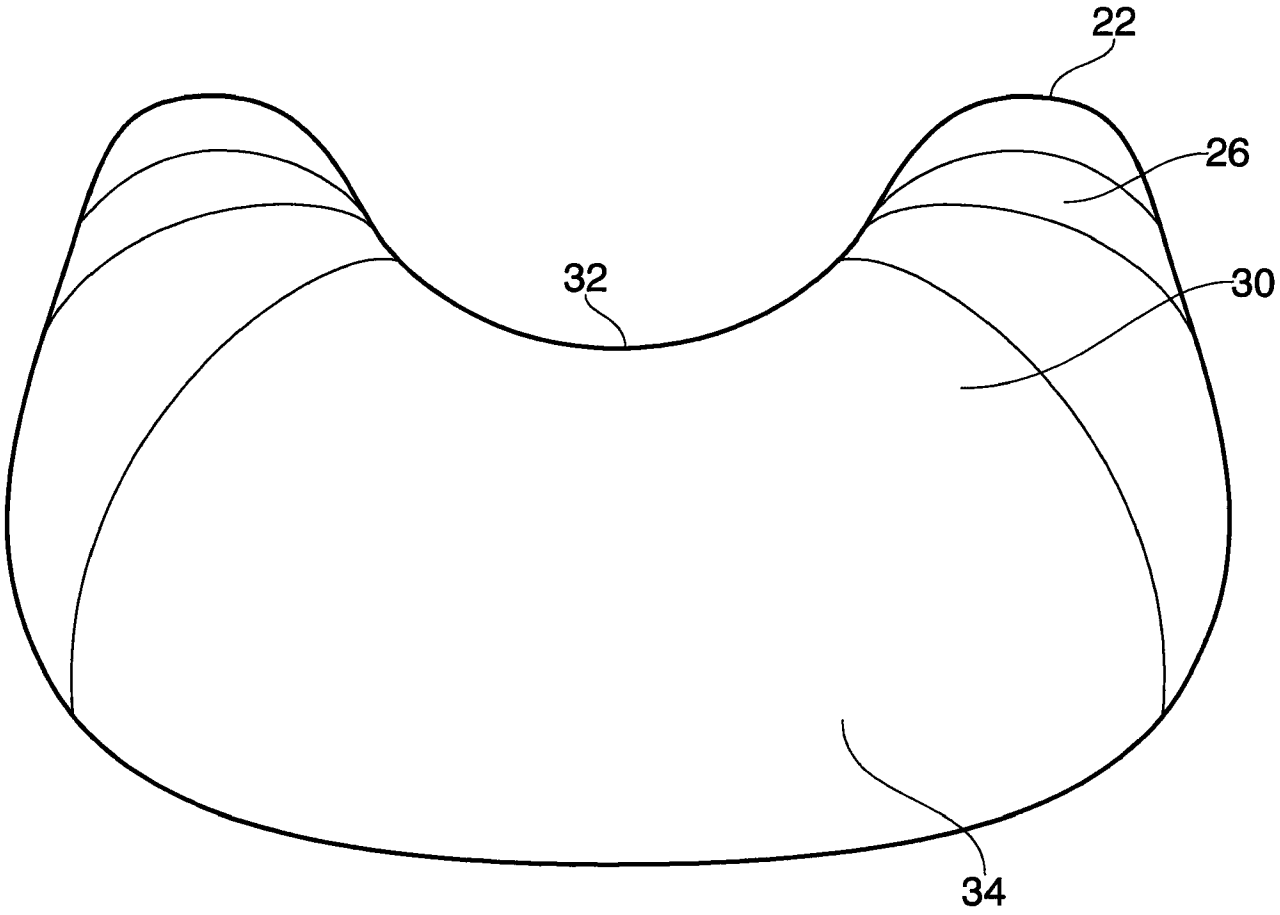
FIG. 3 is a perspective view from one end and above of the product of FIG. 1.
Figure 4:
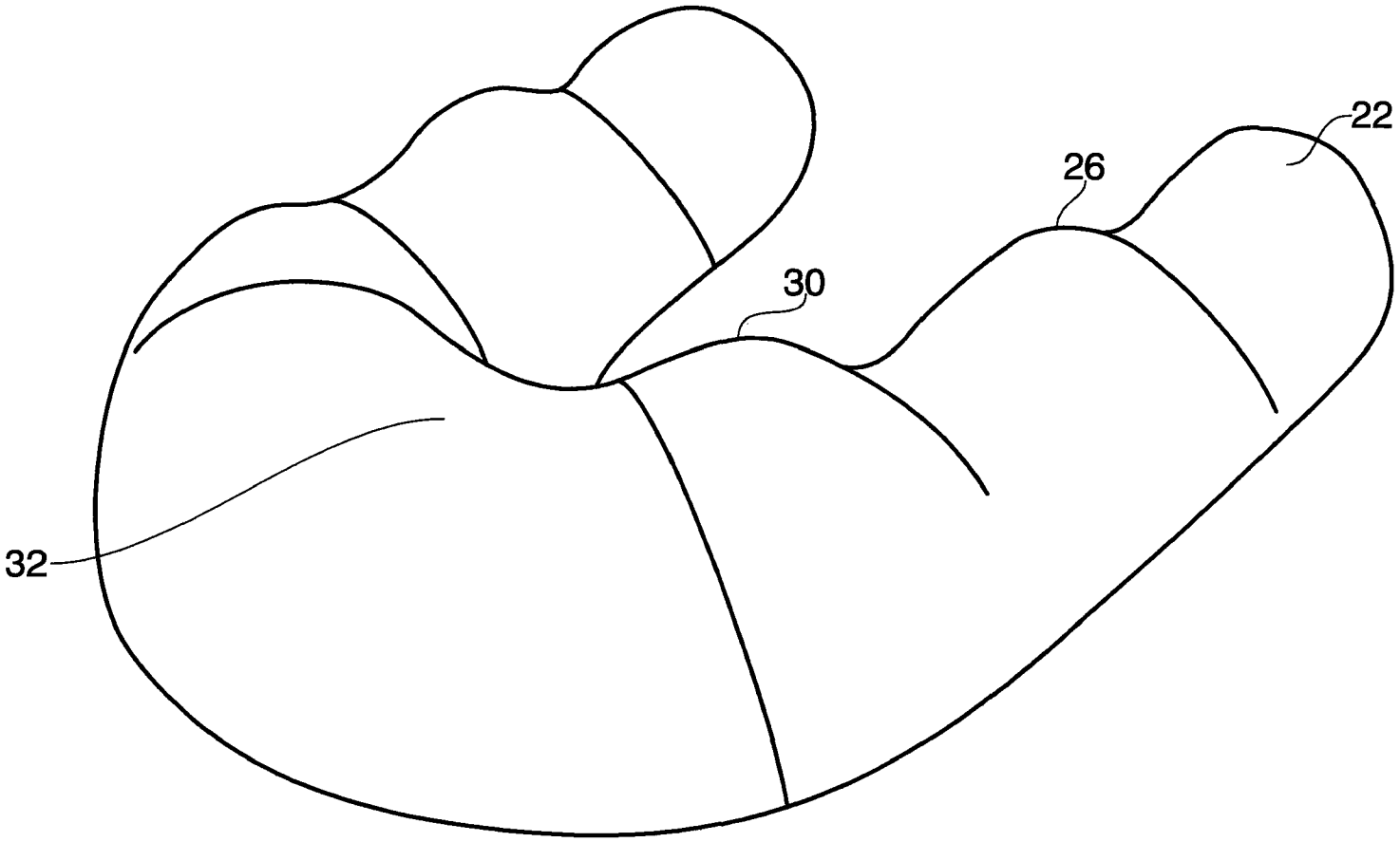
FIG. 4 is a perspective view from one end, above and one side of the product of FIG. 1.
Figure 5:
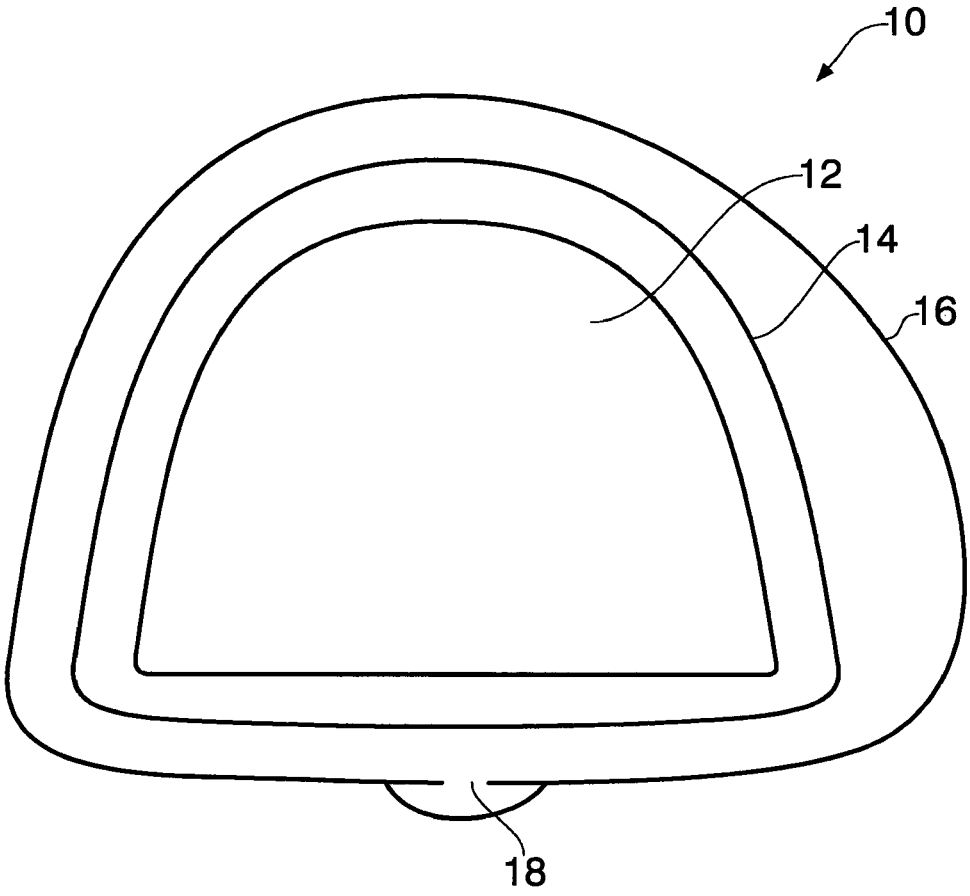
FIG. 5 is a diagrammatic sectional view through the product of FIG. 1.

The drawings show a support product 10 usable for instance in supporting children and particularly disabled children, in for instance positional therapy. The product 10 comprises a profiled body 12, as best illustrated in FIG. 5, of a resilient polyurethane foam. The body 12 is surrounded by a membrane 14 which is air permeable but not permeable to water. The body 12 and surrounding membrane 14 are locatable in a removably washable cover 16 which may be made for instance of a stretch velour or a similar fabric. An elongate fastening 18 is provided such as a sliding hook fastener to permit the cover 16 to be removed from the body 12.

In plan view the product 10 has a generally U shape. The overall height of the body 12 increases from the free ends of the side limbs 20 of the U. The side limbs 20 initially increase in height from their free ends to define a first peak 22 which leads to a first trough 24. There is then provided a second peak 26 generally midway along the side limbs 20. This extends into a second trough 28 leading to a third higher peak 30 towards the ends of the side limbs 20. The third peaks 30 on each side drop to a third trough 32 extending therebetween across the base 34 of the U.

The product 10 can then be used in a number of different applications, some of which are illustrated in FIGS. 6 to 11. By virtue of the cover 16, when used for instance on flooring such as carpet, the relative inclinations of the side limbs 20 can be changed to open out or close the U, to for instance provide lateral support to a prone person.

Figure 6:
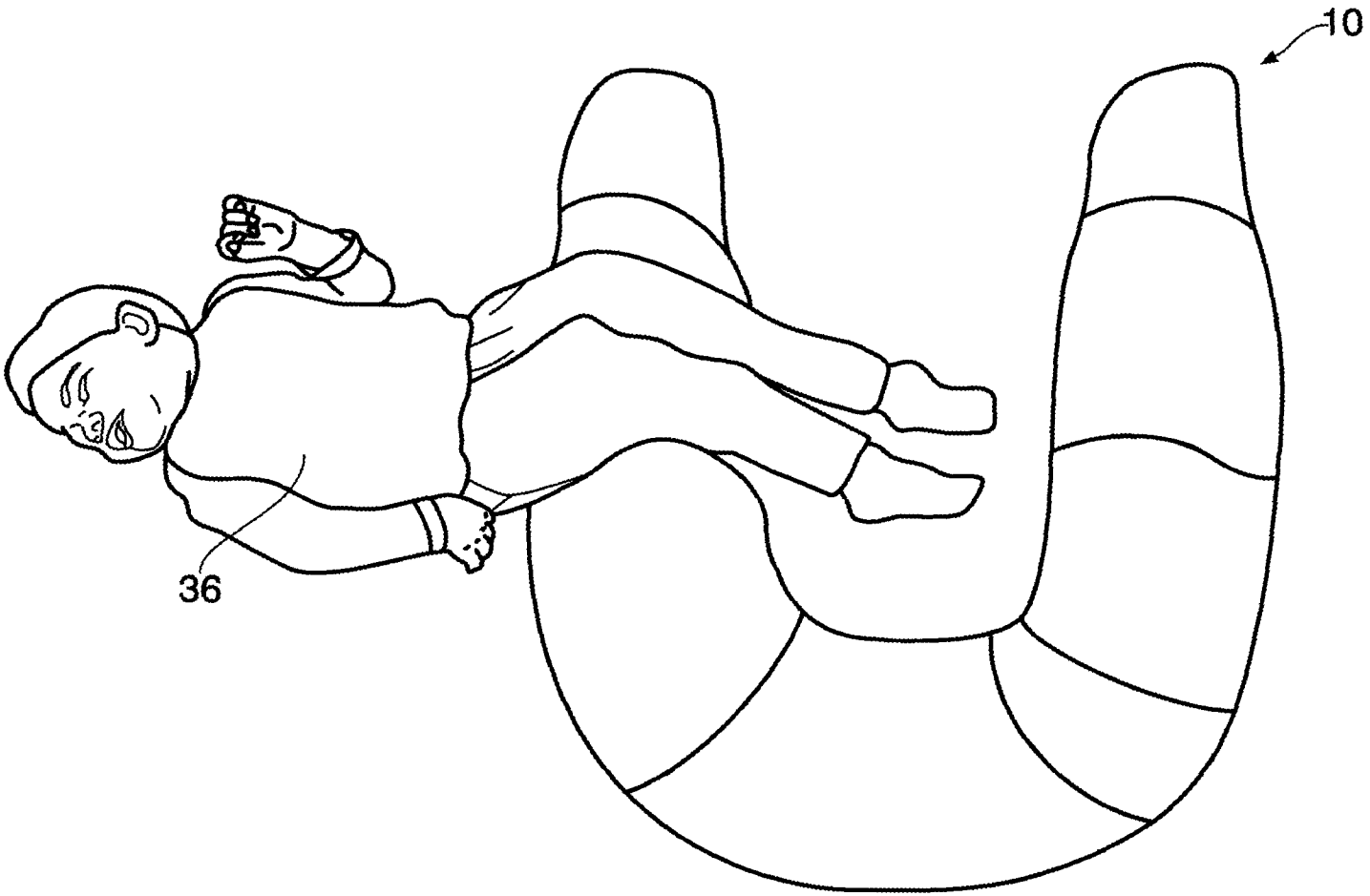
FIG. 6 is a diagrammatic plan view of the product in FIG. 1 in use.

FIG. 6 show a supine child 36 lying sideways relative to the product 10 with the product 10 locating beneath their knees, with their legs located between the second and third peaks 26, 30 to provide support to the child's legs.

Figure 7:
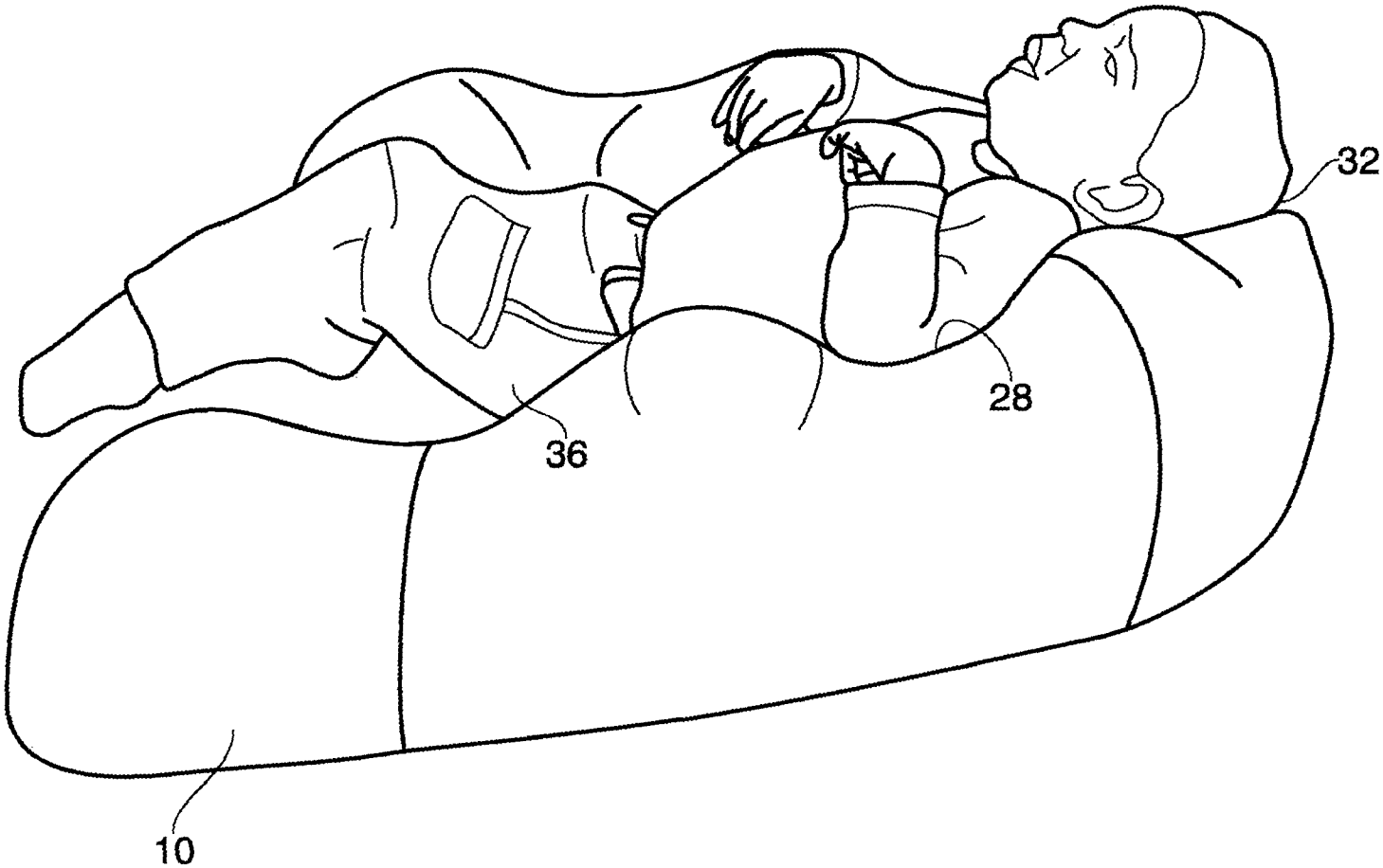
FIG. 7 is a perspective view from one side and above of the product of FIG. 1 in use in a different position.

FIG. 7 shows a supine child 36 being supported with their head locating on the third trough 32, and their elbows locating in the second troughs 28 on each side.

Figure 8:
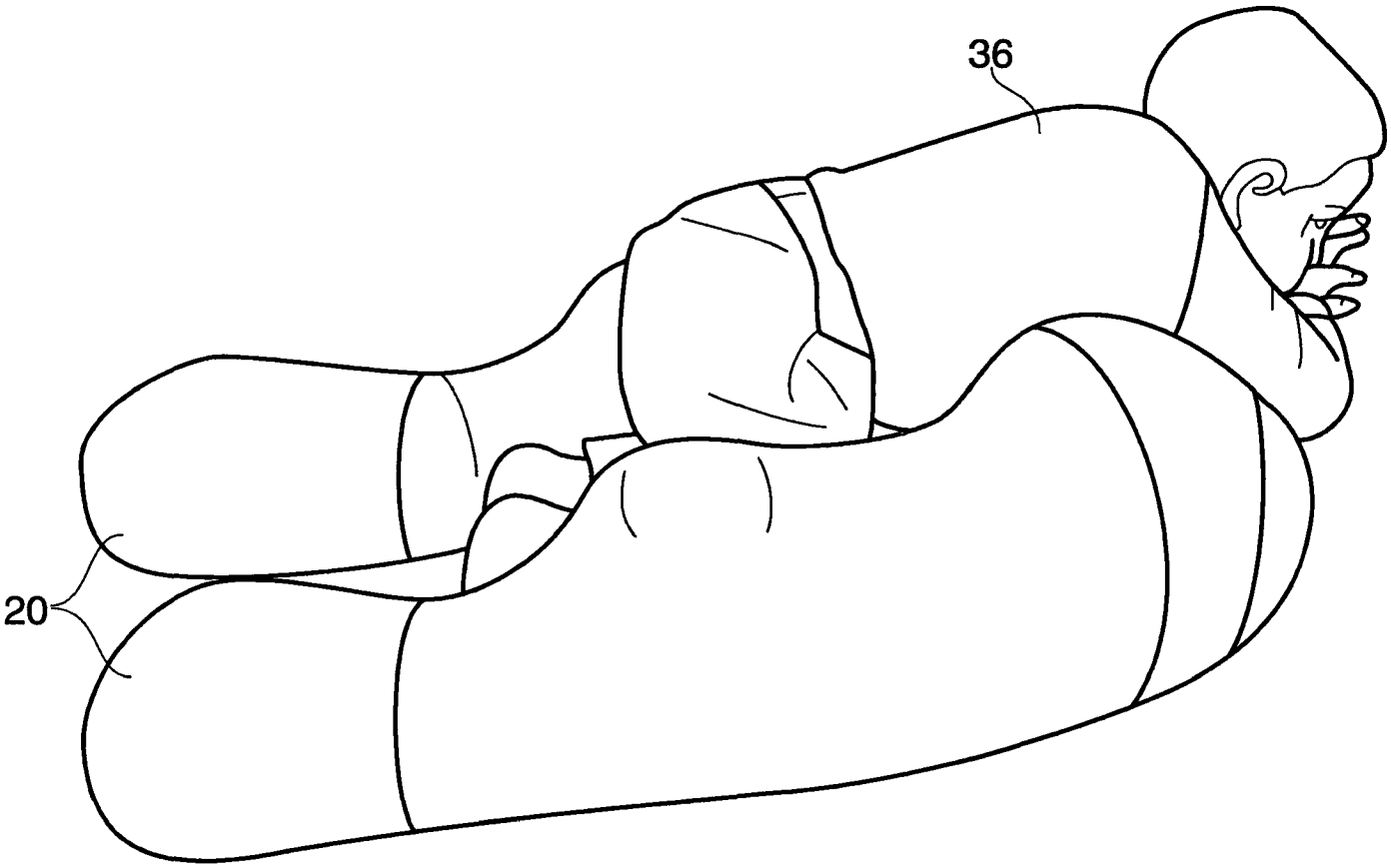
FIG. 8 is a diagrammatic side view, and is a similar view to FIG. 7 but with a child being supported in a further different position.
Figure 9:
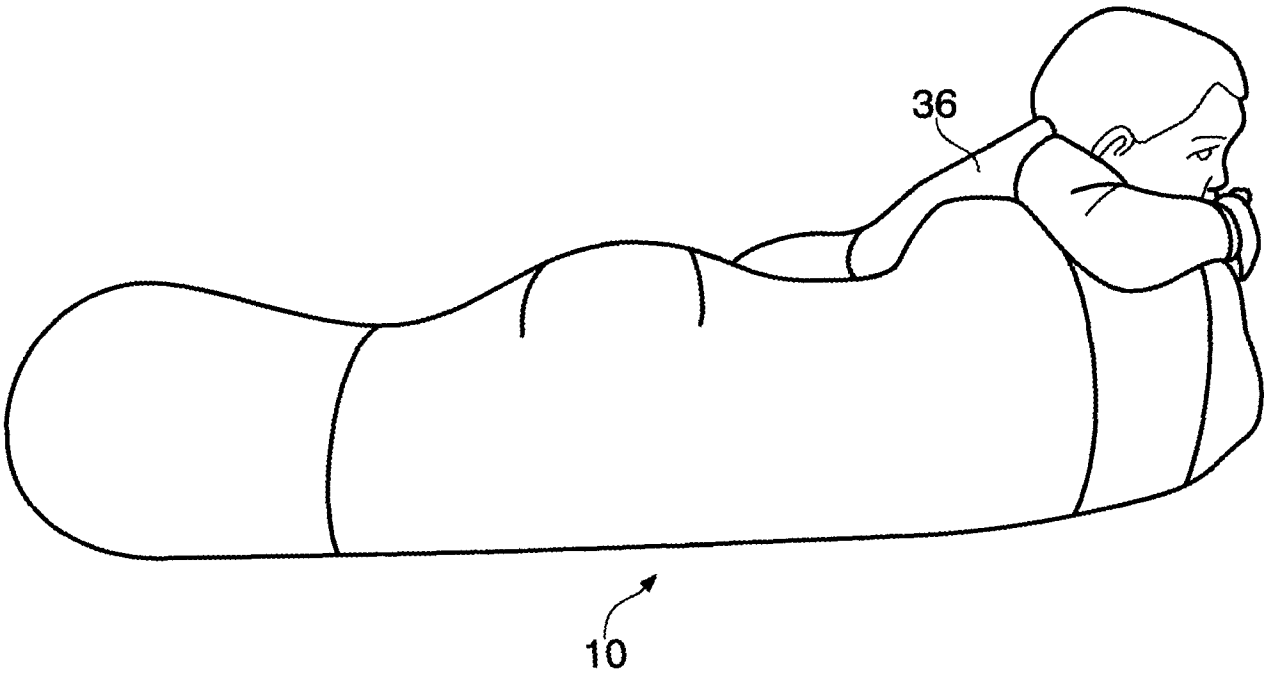
FIG. 9 is a side view of the product of FIG. 1 in use in the further different position.

FIG. 8 shows a child 36 kneeling between the side limbs 20 with their head supported on their arms located resting on the third trough 32. FIG. 9 shows a side view of the child 36 shown in FIG. 8, showing how their arms and chin are supported on the third trough 32.

Figure 10:
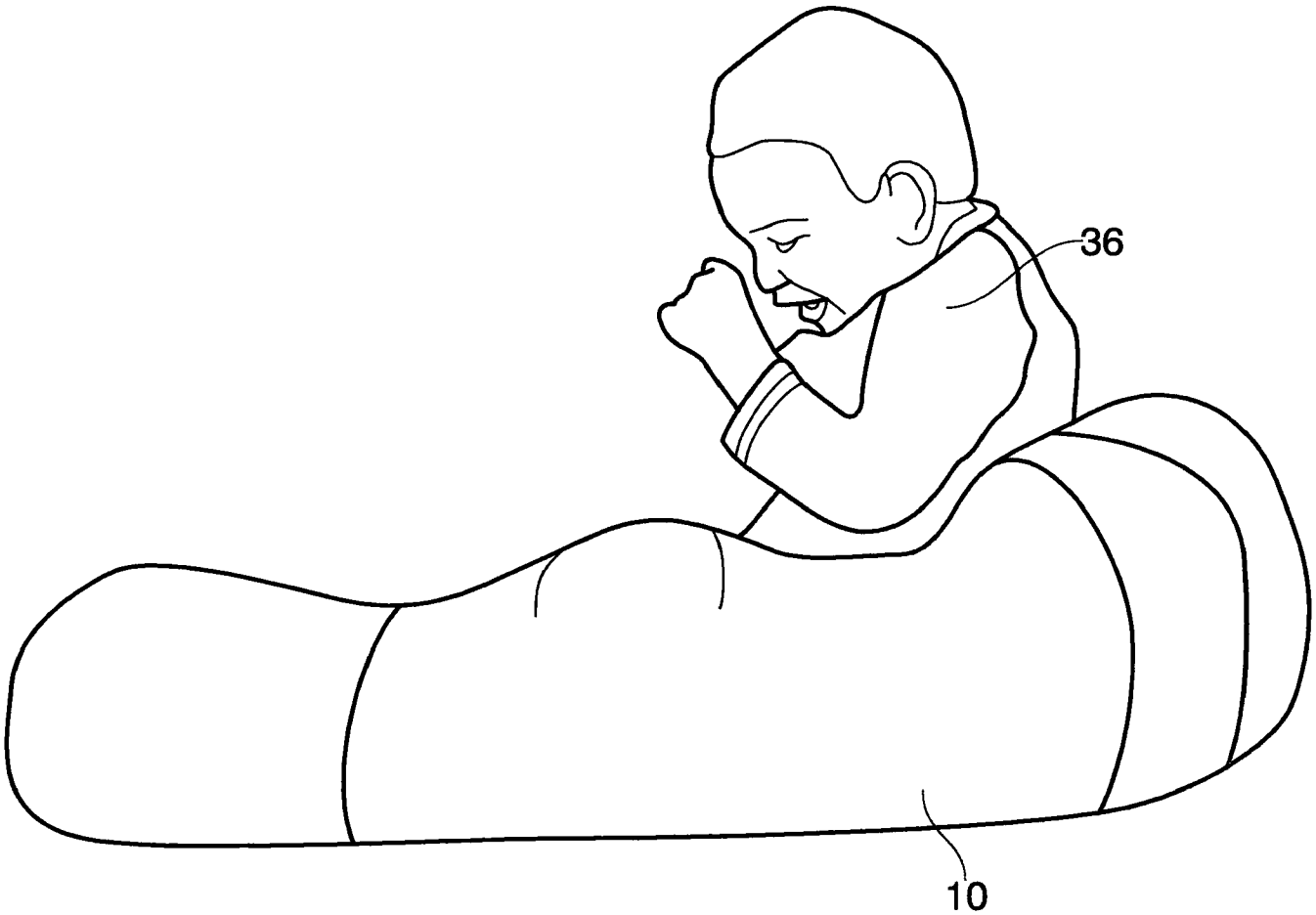
FIG. 10 is a further side view of the product of FIG. 1 in use with a child in a still different position.

FIG. 10 shows a child 36 in a sitting position located within the space surrounded by the U shape of the object 10. As indicated the side limbs 20 can be moved apart or together to facilitate different sizes of children, or to increase or decrease the degree of lateral support.

Figure 11:
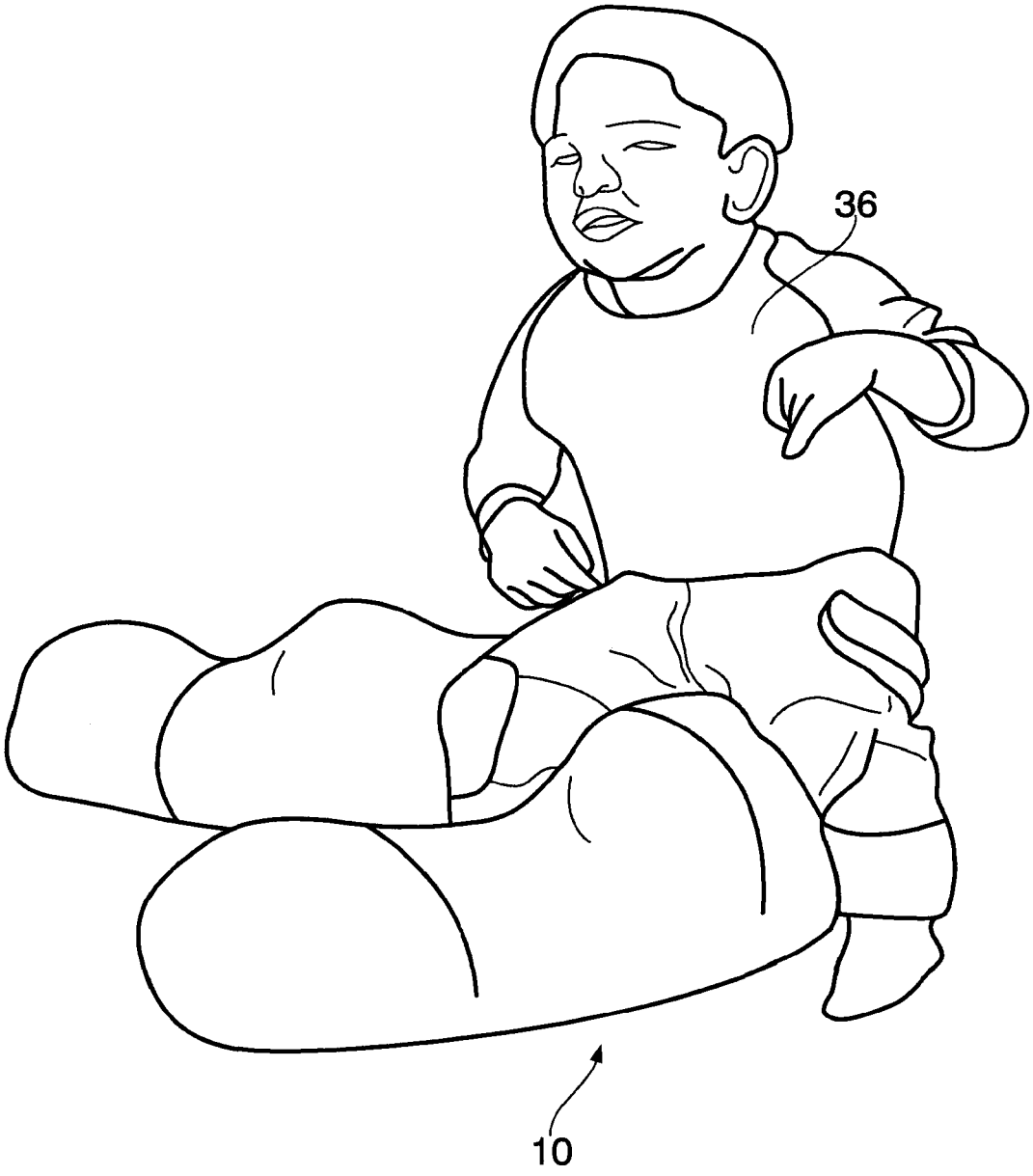
FIG. 11 is a perspective view of the product of FIG. 1 in use in a yet further different position.

FIG. 11 shows a child 36 astride the product 10, and more particularly astride the third trough 32.

There is thus described a support product which can support a person in many different ways, and in many different positions. This means that a single product can be used in many different types of positional therapy, and is readily suited for home use, thereby only requiring the storage of one product.

Various modifications may be made without departing from the scope of the invention. For instance different materials may be used on the product. A different number of troughs and peaks may be provided on the support product.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A ground engageable support product for a person, the product comprising a profiled resilient member which is generally U shaped with two side limbs in plan view, the member having a continuous, generally flat ground engageable surface extending a majority of the length of the profiled member, with a profiled upper surface including a plurality of peaks and troughs along the length of the profiled member, wherein the overall height of the profiled member increases from the free end of each side limb and wherein each side limb of the support product comprises at least two troughs.

2. The support product according to claim 1, characterised in that the product is formed such that the relative inclination of one or both of the side limbs of the U relative to the base of the U, may be varied.

3. The support product according to claim 1, characterised in that at least two peaks with a trough in between are provided on each side limb of the U.

4. The support product according to claim 1, characterised in that a trough is provided at the center of the base of the U.

5. The support product according claim 1, characterised in that the profiled member includes a flexible plastics material profiled core.

6. The support product according to claim 5, characterised in that the core is made of a foamed material.

7. The support product according to claim 6, characterised in that the core is made of polyurethane.

8. The support product according to claim 5, characterised in that a removable washable cover is provided around the profiled core.

9. The support product according to claim 8, characterised in that the cover has an external texture which is engageable with floor coverings to retain the product in a required shape.

10. The support product according to claim 9, characterised in that the cover is made of stretch velour.

11. The support product according to claim 5, characterised in that a protective membrane is provided around the profiled core.

12. The support product according to claim 11, characterised in that the membrane is permeable to air but not water.

* * * * *